US006213927B1

(12) United States Patent
De Matteis et al.

(10) Patent No.: US 6,213,927 B1
(45) Date of Patent: Apr. 10, 2001

(54) INTERFOLDING METHOD OF SHEET MATERIAL NOT OR NOT ENOUGH PERMEABLE TO AIR AND MACHINE FOR CARRYING OUT SUCH METHOD

(75) Inventors: Alessandro De Matteis, Lucca; Sergio Landucci, Ponte a Moriano Lu, both of (IT)

(73) Assignee: M T C - Macchine Trasformazione Carta S.R.L., Porcari Lu (IT)

( * ) Notice: Subject to any disclaimer, the term of this patent is extended or adjusted under 35 U.S.C. 154(b) by 0 days.

(21) Appl. No.: 09/378,015

(22) Filed: Aug. 19, 1999

(30) Foreign Application Priority Data

Aug. 21, 1998 (EP) ..... 98830509

(51) Int. Cl.[7] ..... B31F 7/00

(52) U.S. Cl. ..... 493/360; 493/429; 493/430; 493/356; 493/357; 493/359

(58) Field of Search ..... 493/360, 359, 493/357, 356, 430, 429, 363, 370, 428

(56) References Cited

U.S. PATENT DOCUMENTS

| | | | | |
|---|---|---|---|---|
| 1,821,713 | * | 9/1931 | Johansen | 493/430 |
| 4,070,014 | | 1/1978 | Takahashi . | |
| 4,494,741 | | 1/1985 | Fischer et al. . | |
| 4,691,908 | * | 9/1987 | Bradley | 493/361 |
| 5,000,729 | * | 3/1991 | Yamauchi | 493/359 |
| 5,147,273 | * | 9/1992 | Rottmann et al. | 493/349 |
| 5,205,808 | * | 4/1993 | Gebhardt | 493/194 |
| 5,310,398 | * | 5/1994 | Yoneyama | 493/430 |

FOREIGN PATENT DOCUMENTS 111210 11/1917 (GB) .

* cited by examiner

*Primary Examiner*—Stephen F. Gerrity
*Assistant Examiner*—Sam Tawfik
(74) *Attorney, Agent, or Firm*—Simpson, Simpson & Snyder, L.L.P.

(57) ABSTRACT

A method and a machine for the production of interfolded stacks (17) formed by a plurality of sheets (4*a*,4*b*) comprising the steps of: transversally cutting or tearing sheets obtained from at least one web (3*a*,3*b*) and offset with respect to one another so that a sequence of offset sheets is created; passage of the sheets on folding rollers (7*a*,7*b*) which comprise sucking means for the alternate holding of the sheets (4*a*,4*b*) in order to obtain an interfolded disposition; formation of a continuous interfolded stack downstream of the folding rollers. Upstream of the folding a step of treatment of the sheets is provided in order to make them, at least in certain zones (14), enough permeable to air, in particular through perforating means. These perforating means can be provided on rollers (10*a*,10*b*) having sharpened points (11*a*,11*b*).

9 Claims, 2 Drawing Sheets

Fig. 2
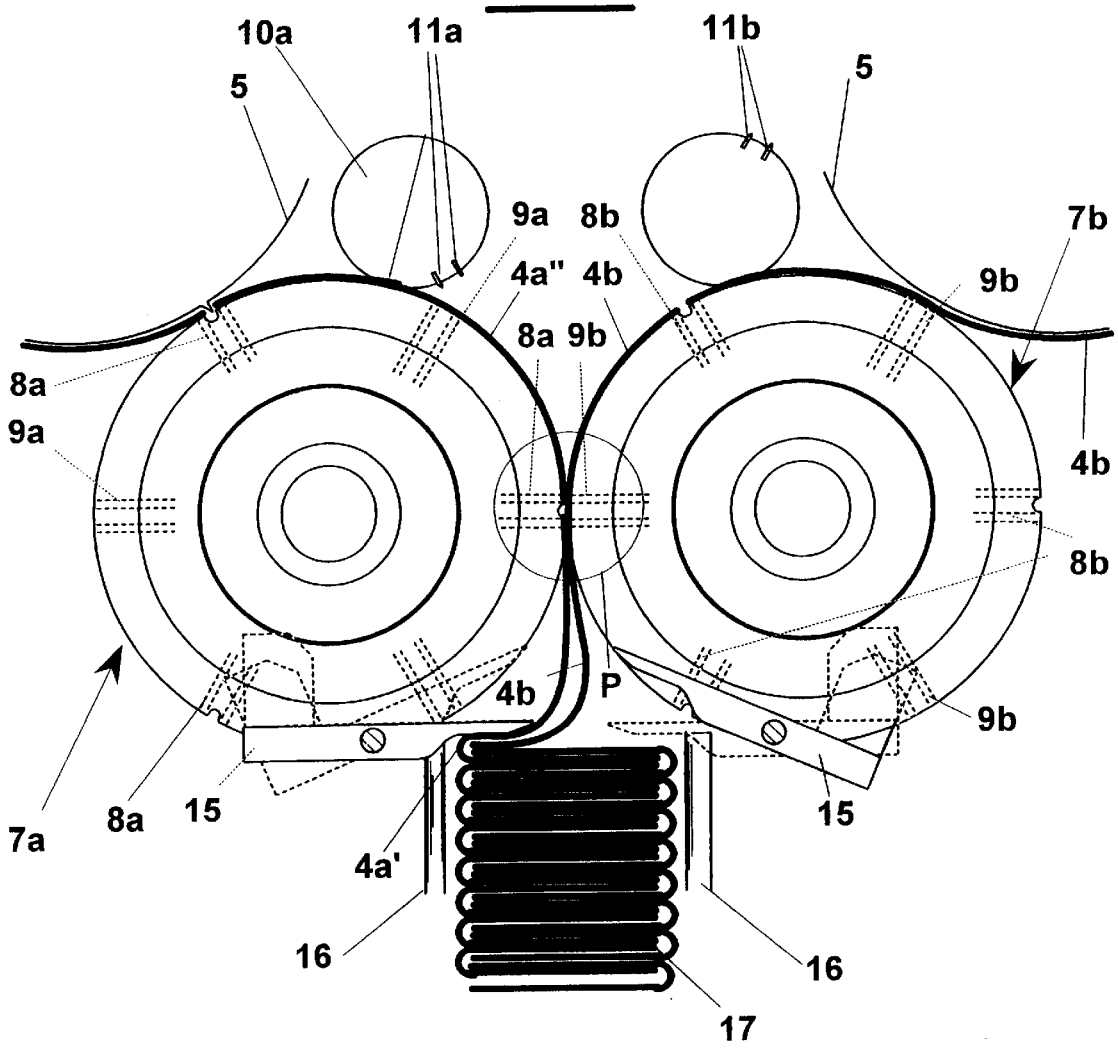
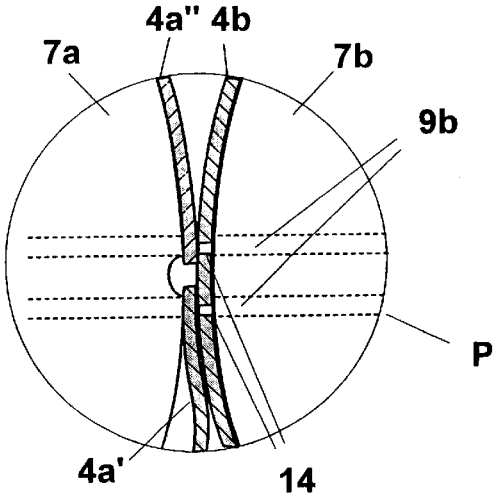
Fig. 3

INTERFOLDING METHOD OF SHEET MATERIAL NOT OR NOT ENOUGH PERMEABLE TO AIR AND MACHINE FOR CARRYING OUT SUCH METHOD

FIELD OF THE INVENTION

The present invention generally relates to paper converting machines and more precisely it relates to the production of interfolded stacks of paper sheets, for example paper wipers, toilet paper, napkins and the like.

In particular, it relates to an interfolding method of sheet material not or not enough permeable to air.

The invention relates also to the machine used to carry out such method.

BACKGROUND OF THE INVENTION

Wipers, certain types of toilet paper, paper napkins and the like are packed in stacks of a fixed height. They are made starting from sheets of absorbent material, for example "tissue" paper, non-woven fabric, etc.

The production starts from a web having a large transversal width, from which sheets are obtained that are folded, stacked and divided into small stacks of a height equal to the final product. Each of these small stacks forms a log of a length equal to said transversal size. The logs, then, are cut off into many short stacks having the final size and packed.

In some cases the sheets obtained from the web are folded separately from one another and then stacked already folded. In other cases the sheets are interfolded, that is, are folded into panels by overlapping at the same time a panel of a previous sheet with a panel of a following sheet. In this way, when pulling a sheet from the stack, at the moment of use, a panel of the following sheet is pulled out, with consequent advantages for certain types of users. Among the possible interfolding ways stacks of L, Z or W interfolded sheets are known having 2, 3 and 4 panels respectively.

For the production of interfolded stacks, machines are known that use one or two webs of paper coming from a reel that are cut into sheets and then supplied offset with respect to one another on folding counter-rotating rollers.

More precisely, the cutting step of the webs into sheets is carried out by cutting rollers that engage with respective blades. In case of L or W interfolding the webs are cut so that they form a sequence of offset sheets coming preferably from two different directions. Therefore, the sheets coming from both directions are supplied alternately to the folding rollers so that each sheet coming from a first direction overlaps a portion of the sheet coming from the second direction, and vice versa.

The sheets coming from both directions, in order to be overlapped in the above described way, adhere to the respective folding rollers by means of a sucking step or by means of a mechanical gripping. Therefore, the downstream portion of each sheet leaves its folding roller at the point of contact between the two rollers, then adhering to the other folding roller, to which the upstream portion of the previous sheet adhered.

The interfolded stacking step is carried out by fixed shrouds or by folding arms that have an oscillating motion about a pivot and that in turn push away from the respective roller the upstream portion of each sheet joined to the overlapped downstream portion of the following sheet.

In case of Z interfolding there is the only difference that two consecutive sheets overlap each other just after the cutting step and the sequence of overlapping and offset sheets come to the folding rollers from only one direction.

In the machine in which the folding rollers comprise mechanical grippers there is the drawback that such system is very expensive and complex to use.

Instead, in the machine in which the sheets adhere to the folding rollers through sucking means, the downstream portions of the sheets are held owing to their permeability to air. In fact, they are held in turn by one or by the other folding roller through the forces generated by air owing to the friction pressure loss throughout the paper.

Therefore, the method of holding the sheets by sucking, advantageous because less expensive of the gripping means, cannot be used when the material to interfold is not or not enough permeable to air. This may occur when the web is thicker than usual or because the web has special physical features.

Consequently, the need is felt of a method and of an apparatus for interfolding sheet material not or not enough permeable to air that is easier to control and less expensive than the gripping means.

It is therefore object of the present invention to provide a new interfolding method of sheet material not or not enough permeable to air.

It is another object of the present invention to provide an apparatus for carrying out such a method.

SUMMARY OF THE INVENTION

These and other objects are achieved by the method for the production of interfolded stacks, formed by a plurality of sheets, comprising the steps of:

- feeding of sheets in succession so that a sequence of sheets is created on folding rollers that comprise sucking spots;
- alternate holding of the sheets by said rollers by means of said sucking spots in order to obtain an interfolded disposition;
- folding and formation of the interfolded stack of sheets by means of folding arms that push in turn on a plane of formation, these sheets coming in succession from said rollers partially overlapped to one another.

The peculiarity of the method is that said supplying step provides the treatment of these sheets in order to make them enough permeable to air in zones corresponding to said sucking spots. This way, the sucking spots can hold two overlapped portions of consecutive sheets on the same folding roller.

Advantageously, the treatment of these sheets in order to make them enough permeable to air in zones corresponding to said sucking spots provides the step of perforating said sheets. This way, in the sucking spots in which there are two portions of sheet overlapping each other, the passage of air which is sucked through the perforations made on the first sheet causes the second sheet to adhere to the first sheet also if the paper of the first sheet is not or not enough permeable to air, thus allowing the interfolding machine to operate correctly.

Preferably, the perforations are made on the sheets when they have already come to the folding rollers by means of needles that penetrate into said sucking spots. In this way it is assured in an easy way that the perforations made on the web correspond to the sucking spots.

The interfolding machine used to carry out the method for the production of interfolded stacks formed by a plurality of sheets comprises:

- folding rollers counter-rotating with respect to each other supplied with sheets in succession;

sucking means, arranged in these rollers but in communication with their periphery at sucking spots, suitable for causing the sheets to adhere alternately to it;

interfolding means suitable for the formation of a stack of sheets;

perforating means upstream of the folding step to make a perforation on said sheets, said perforation corresponding to said sucking spots.

Advantageously, the perforating means comprises a roller from which perforating needles protrude.

The perforating rollers can perforate the paper directly on the folding roller at the sucking spots, or upstream of it.

In the former case the surface speed of the perforating rollers coincides with the surface speed of the folding roller.

In the latter case the timing of perforation is such that the holes on the paper correspond to the sucking spots.

BRIEF DESCRIPTION OF THE DRAWINGS

Further characteristics and the advantages of the method and of the apparatus for interfolding sheet material not or not enough permeable to air, according to the present invention, will be made clearer with the following, but not limitative, exemplifying description of several exemplifying embodiments thereof, with reference to the attached drawings, wherein:

FIG. 2 shows a detailed view of an embodiment of the folding rollers of the machine of FIG. 1.

FIG. 3 shows a detailed enlarged view of the point of contact between the folding rollers of FIG. 2 when working.

DESCRIPTION OF THE PREFERRED EMBODIMENTS

Figure 1:
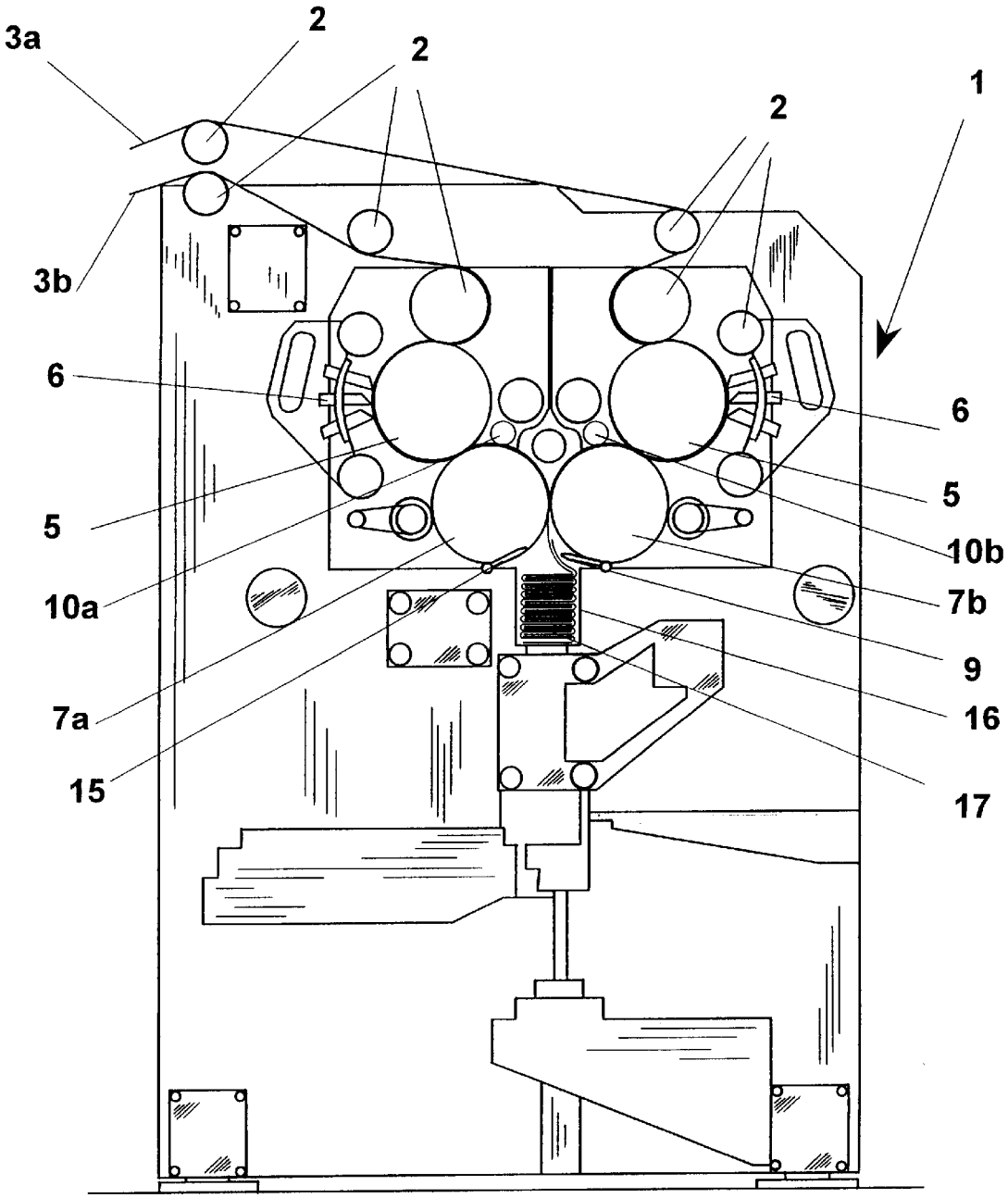
FIG. 1 shows a cross sectional view of an embodiment of the machine used to carry out the interfolding method of sheet material not or not enough permeable to air, according to the present invention.

With reference to FIG. 1, a machine 1 for carrying out the method according to the invention for interfolding sheet material not or not enough permeable to air comprises deviating rollers 2 for supplying and stretching a web 3*a* coming from a first reel and a web 3*b* coming from a second reel.

The two webs 3*a* and 3*b* are supplied to cutting rollers 5 by which they are cut on blades 6 so that they form a sequence of offset sheets 4*a* and 4*b* (FIG. 2). This sequence is such that two portions of the sheets 4*a* obtained from the first web 3*a* overlap a sheet 4*b* obtained from the second web 3*b*, and vice versa.

Sheets 4*a* and 4*b* come to folding rollers 7*a* and 7*b* comprising (FIG. 2) first sucking spots 8*a* and 8*b*, in three rows angularly spaced 120° from one another, and second sucking spots 9*a* and 9*b* also in three rows spaced 120° from one another.

Folding rollers 7*a* and 7*b* are counter-rotating with respect to each other and their point of contact is indicated as P. Sucking spots 8*a* and 9*a* of roller 7*a* respectively coincide at point P with sucking spots 9*b* and 8*b*, respectively, of roller 7*b*. Folding rollers 7*a* and 7*b* have external circumferences three times the length of sheets 4*a* and 4*b*, respectively, and the latter have respectively beginnings and ends at sucking spots 8*a* and 8*b*, respectively, where a groove is provided (FIG. 2) to prevent the blade of roller 5 from hitting against rollers 7*a* and 7*b*.

The vacuum at sucking spots 8*a*, 8*b* and 9*a*, 9*b* is delivered only at certain angles of the turn of rollers 7*a* and 7*b*. More precisely, spots 8*a* and 8*b* suck sheets 4*a* and 4*b* upstream of point P, whereas spots 9*a* and 9*b* suck sheets 4*a* and 4*b* downstream of point P. In other words, sucking spots 8*a* and 8*b* have the task of dragging sheets 4*a* and 4*b* still separated from one another up to point P of contact between the two folding rollers respectively 7*a* and 7*b*. While continuing the rotation further point P, sucking spots 8*a* and 8*b* stop sucking and one of the two sheets, 4*a* or 4*b*, passes to the other roller, 7*b* or 7*a*, respectively, that through sucking spots 9*a* and 9*b* has started sucking after having passed point P.

The beginning or the end of the sucking steps is obtained by means of fixed channels and vacuum delivery valves, not shown because known in the art and therefore obvious for a man skilled in the art, arranged inside folding rollers 7*a* and 7*b*.

As shown in FIG. 2, according to the invention, rollers 10*a* and 10*b* are provided having needles 11*a* and 11*b* that penetrate sucking spots 9*a* and 9*b* of folding rollers 7*a* and 7*b*. Sheets 4*a* and 4*b* are then perforated in 14 (FIG. 3) respectively by needles 11*a* and 11*b* at sucking spots 9*a* and 9*b*.

For example, in FIG. 3 sheet 4*b* is shown as facing both point P and a sheet 4*a*′ that has just left point P followed by a sheet 4*a*″. Sheet 4*b* has a downstream portion that has passed point P and an upstream portion that adheres to roller 7*b*. From the other side, the downstream portion of sheet 4*a*′ is held by sucking spots 8*a* and pulled up to point P. Here sucking spots 9*b* are activated and, through holes 14, they separate the upstream portion of sheet 4*a*′ and the downstream portion of sheet 4*a*″ from roller 7*a* pulling them together with sheet 4*b* up to folding arms 15 (FIGS. 1 and 2).

This way the pairing is obtained of the two sheets 4*a* and 4*b* made of paper not or not enough permeable to air that are pushed between guides 16 and form below an interfolded stack 17 shown in FIG. 2.

Alternatively, wheels 10*a* and 10*b* can also be provided in machine 1 more upstream than in the embodiment shown above, for example upstream of the cutting zone of webs 3*a* and 3*b*. In this case, the perforating is timed so that holes 14 always coincide at the passage with sucking spots 9*a* and 9*b*.

Always alternatively, instead of perforations 14 also short cuts, incisions or abrasions in the sheets can be made. Treatments with substances that increase the permeability may be carried out as well, for example with wet substances, so that the sheets become permeable to air and allow, through them, the sucking of the sheets that are being interfolded.

Notwithstanding reference has been made to sheets cut by means of cutting roller 5 and blade 6, it is also possible that the sheets are obtained by means of tearing a continuous web with transversal perforations.

Moreover, the sheets can be obtained from a web of paper starting from a single reel instead of two or more reels.

Notwithstanding, finally, in the description and in the drawings reference has been made to the case of L interfolding, it is clear that the concepts above described are adaptable without difficulty to the case of W or Z interfolding, in a way obvious to a person skilled in the art.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A method for production of interfolded stacks formed by a plurality of sheets comprising the steps of:

transversally separating said plurality of sheets, obtained from at least one web, offset with respect to one another so that a sequence of offset sheets is created, where each of said separated sheets has a first end and a second end;

puncturing each of said separated sheets with puncturing means at a location between said first and second ends to render said separated sheets permeable to air;

passing said separated sheets onto folding rollers which comprise sucking means for the alternate holding of said sheets in order to obtain an interfolded disposition;

formation of a continuous interfolded stack downstream of said folding rollers.

2. A method as recited in claim 1 wherein said puncturing comprises perforating.

3. A method as recited in claim 2 wherein said puncturing means comprises a roller having outwardly extending needles that engage corresponding apertures in said folding rollers.

4. A method as recited in claim 2 wherein said perforating is arranged to have a speed of perforation which corresponds to a speed of operation of said sucking means.

5. A method as recited in claim 2 wherein a surface speed of said perforating corresponds with a surface speed of said sucking means.

6. An interfolding machine for the formation of stacks of interfolded sheets, comprising:

separating means for separating sheets from a web;

perforating means operatively arranged to perforate each of said separated sheets between first and second ends of said separated sheets;

folding rollers counter-rotating with respect to each other, said folding rollers supplied with separated sheets from at least one web;

sucking means located within each of said folding rollers and in communication with a periphery of each of said folding rollers, operatively arranged to hold said separated sheets in an alternating arrangement on said folding rollers; and, interfolding means operatively arranged to form a stack of interfolded sheets.

7. An interfolding machine as recited in claim 6 wherein said perforation means and said sucking means are operatively arranged to operate at the same time.

8. An interfolding machine as recited in claim 6 wherein said perforating means comprises rollers having perforation tools.

9. An interfolding machine as recited in claim 8 wherein said perforation tools comprise outwardly extending needles.

* * * * *